United States Patent [19]

Matsuguchi

[11] Patent Number: 4,585,505

[45] Date of Patent: Apr. 29, 1986

[54] PRESSURE SENSITIVE LABEL APPLICATION DEVICE

[75] Inventor: Yutaka Matsuguchi, Osaka, Japan

[73] Assignee: Osaka Sealing Printing Co., Ltd., Osaka, Japan

[21] Appl. No.: 546,528

[22] Filed: Oct. 28, 1983

[30] Foreign Application Priority Data

Oct. 30, 1982 [JP] Japan ..... 57-191618

[51] Int. Cl.[4] ..... B65H 26/00

[52] U.S. Cl. ..... 156/361; 156/363; 156/342

[58] Field of Search ..... 156/361-363, 156/351, 584, 542

[56] References Cited

U.S. PATENT DOCUMENTS

| | | | |
|---|---|---|---|
| Re. 30,419 | 10/1980 | Crankshaw et al. | 156/584 |
| 4,106,972 | 8/1978 | Caudill | 156/363 |
| 4,183,779 | 1/1980 | Barber et al. | 156/361 |
| 4,264,396 | 4/1981 | Stewart | 156/542 |
| 4,276,112 | 6/1981 | French et al. | 156/542 X |
| 4,294,644 | 10/1981 | Anderson | 156/361 |
| 4,397,709 | 8/1983 | Schwenger | 156/351 |
| 4,434,911 | 3/1984 | Sakura | 156/542 X |

*Primary Examiner*—David Simmons

*Attorney, Agent, or Firm*—Birch, Stewart, Kolasch & Birch

[57] ABSTRACT

This invention relates to a pressure sensitive label application device. The device is designed to strip a pressure sensitive label off a continuous line of labels temporarily adhered to the surface of a web of supporting or backing material and to adhere each stripped-off label to an article to which the label is to be adhered. The device includes an input unit, a fixed label detector and a control means. The input unit is adapted to input a set value thereinto required for setting a label pitch. The label detector detects the presence of the labels temporarily adhered to the backing material and sends a label detection signal to the control means. Upon receipt of the set value and the label detection signal, the control ascertains the position of the label and controls the label application device to permit the correct application of the label to the article. The device may include a detector for detecting the article. The detector for the article detects the presence of the articles being transferred by a conveyor and sends an article detecting signal to the control means. The control means controls the label application device such that the device can precisely adhere labels to articles by the label detecting signal, the article detecting signal, and the set value. The invention thus provides the exact adhesion of the labels to the articles.

3 Claims, 9 Drawing Figures

PRESSURE SENSITIVE LABEL APPLICATION DEVICE

BACKGROUND OF THE INVENTION

Heretofore, a pressure sensitive label application device was provided with a label detector 4 in a manner to detect the rear end position of a label 3 at the point of time at which the front end of the label 3 comes into contact with an article adapted to have the label 3 adhered thereto in accordance with the size of the label 3 adhered temporarily and continuously to a web of releasable backing material. The label detector 4 detected the state of "non-presence" of label 3 between the labels 3 as shown in FIG. 8*a* when the front end of the label 3 had reached the position at which the front end of the label 3 came into contact with the article (not shown). The device started applying the label 3 to the article, when the application device detected the position in which the front end of the label came into contact with the article. In this manner, the label 3 was adhered to the article.

The device in conventional use, however, was unable to apply the label 3 to the exact position of the article when the label being forwardly conveyed changed in its kind and size. As a result, it was necessary to move the label detector 4 to an exact position. Namely, the detector 4 had to be moved to the position in which the detector 4 could detect the state of "non-presence" of the label, as shown in FIG. 8*a*, in the case wherein as shown in FIG. 8*b*, the label detector 5 was detecting the state of "presence" of the label 3 when the front end of the label 3 came into contact with the article.

In that case, it needed time and labor to move the detector 4 to the position in which the detector could detect the state of "non-presence" of the label 3. In addition, it was not always easy to move the detector 4 to such a position. Accordingly, when there was change in the kind and size of the label 3 in the conventional devices, movement of the label detector 4 was a very cumbersome operation that required time and labor. Moreover, correctness in application of the label to the exact position of the article was hardly expected from the conventional application devices.

SUMMARY OF THE INVENTION

This invention has been worked out in view of the circumstances above. The invention relates to a pressure sensitive label application device capable of making label detection by use of an input unit, a label detector, and a control means included therein.

An object of the invention is to provide a pressure sensitive label application device which can judge the proper position of the label by merely changing a set value for an input unit by numerical processing, even if there is a change in the size and pitch of the label to be applied to an article.

This invention is characterized in that it comprises an input unit capable of inputting a numerical set value, a label detector which detects the sensitive label temporarily adhered to a releasable backing material to send a label detection signal, and a control means which correctly judges and controls the position of the label by the set value and the label detection signal.

The users are enabled by the invention to obtain a pressure sensitive label application device capable of judging the proper position of the label by merely changing the set value for the input unit by numerical processing, even if there is change in the size and pitch of the label to be adhered to an article.

DETAILED DESCRIPTION OF THE PREFERRED EMBODIMENT

Figure 1:
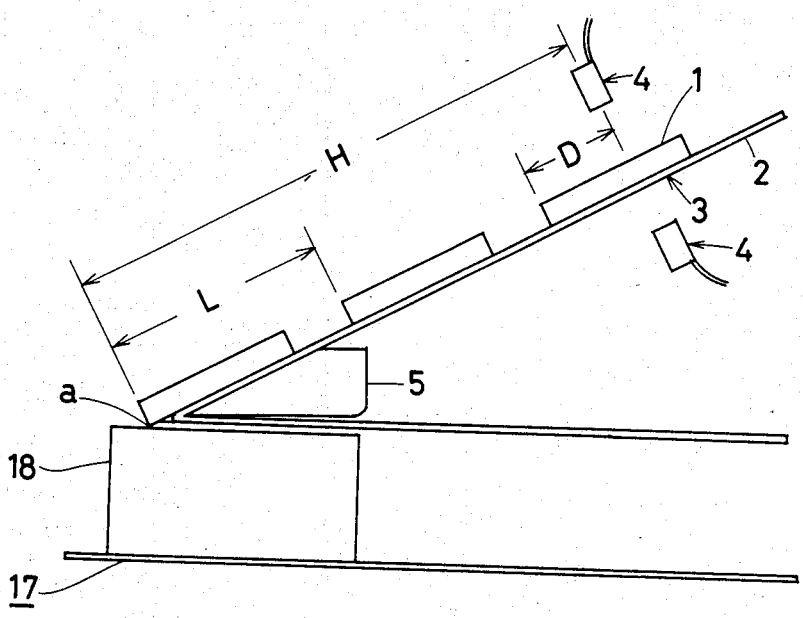
FIG. 1 is a diagrammatic front elevation of the label detector and its peripheral units constituting the essential components of an embodiment of the invention.
Figure 2:
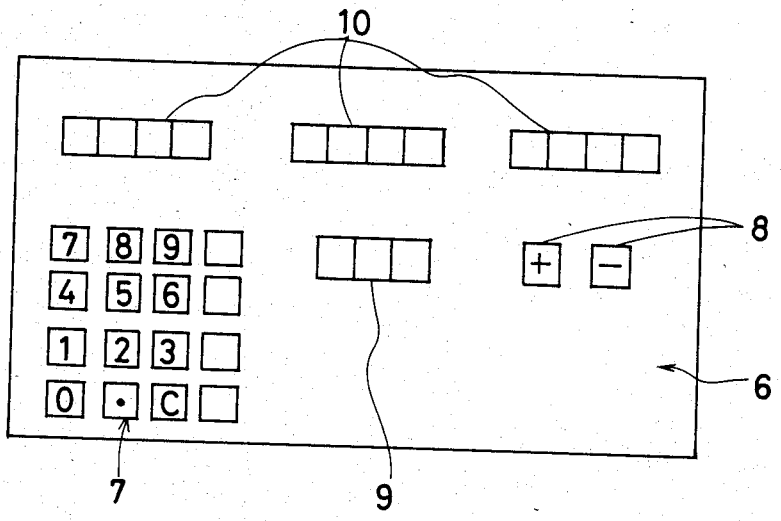
FIG. 2 is a front elevation showing the input unit according to the embodiment of the invention.

A detailed description will now be given of a preferred embodiment of the invention with reference to the accompanying drawings.

The numeral 1 designates a pressure sensitive label The label is made of a piece of paper or synthetic resin, and is printed on the upper side and has an adhesive agent such as a pressure sensitive adhesive agent applied to the underside thereof, and is continuously arranged in a sheetlike form. The label 1 is continuously, temporarily and at a specified interval adhered to the upper side of a releasing supporting or backing material 2 through a releasing agent such as silicone, whereby the labels 1 thus adhered are provided in the form of a continuous line of labels 3.

The numeral 4 designates a label detector. The label detector 4 comprises a light source such as of light-emitting diodes or photoelectric tubes, and a photosensor such as Cds, photodiodes or phototransistors. The light source and the photosensor constituting the label detector 4 are installed on each side of a line of labels 3 in a manner to sandwich the label 3 therebetween. In practice, a photoelectric switch consisting of a photocoupler may be used as the label detector 4.

The numeral 5 designates a releasing means. The means 5 has an acute angle and is made of a hard material such as metal or synthetic resin. The means 5 folds the releasable backing material 2 for the label 3 abruptly in an opposite direction to thereby strip the material 2 of a pressure sensitive label 1.

The numeral 6 designates an input unit which comprises a tens-key 7, a plus-minus key 8, a selection key 9, and a display 10. The tens-key 7 of the unit 6 is a key for numerically inputting a set value. The plus-minus key 8 of the unit 6 is a key for selecting plus and minus of the set value. The selection key 9 of the unit 6 is a key for selecting kinds of set value. The display 10 of the input unit 6 is intended to numerically display a set value.

The numeral 16 designates an article detector for detecting an article 18 being carried forwardly by a conveyor 17 such as a belt conveyor. The article detector 16 comprises a light source consisting of light-emitting diodes or photoelectric tubes, and a photosensor such as Cds, photodiodes or phototransistors. The light source and the photosensor constituting the article detector are installed on each side of the article 18 in a manner to sandwich the article 18 carried forwardly by a conveyor such as a belt conveyor between the light source and the photosensor. The article detector 16 detects the position of the article 18. In practice, a photoelectric switch such as a photocoupler may be used as the article detector 16.

The characters A, H and L designate set value numerically input by an input unit 6 thereinto.

Figures 6, 7:
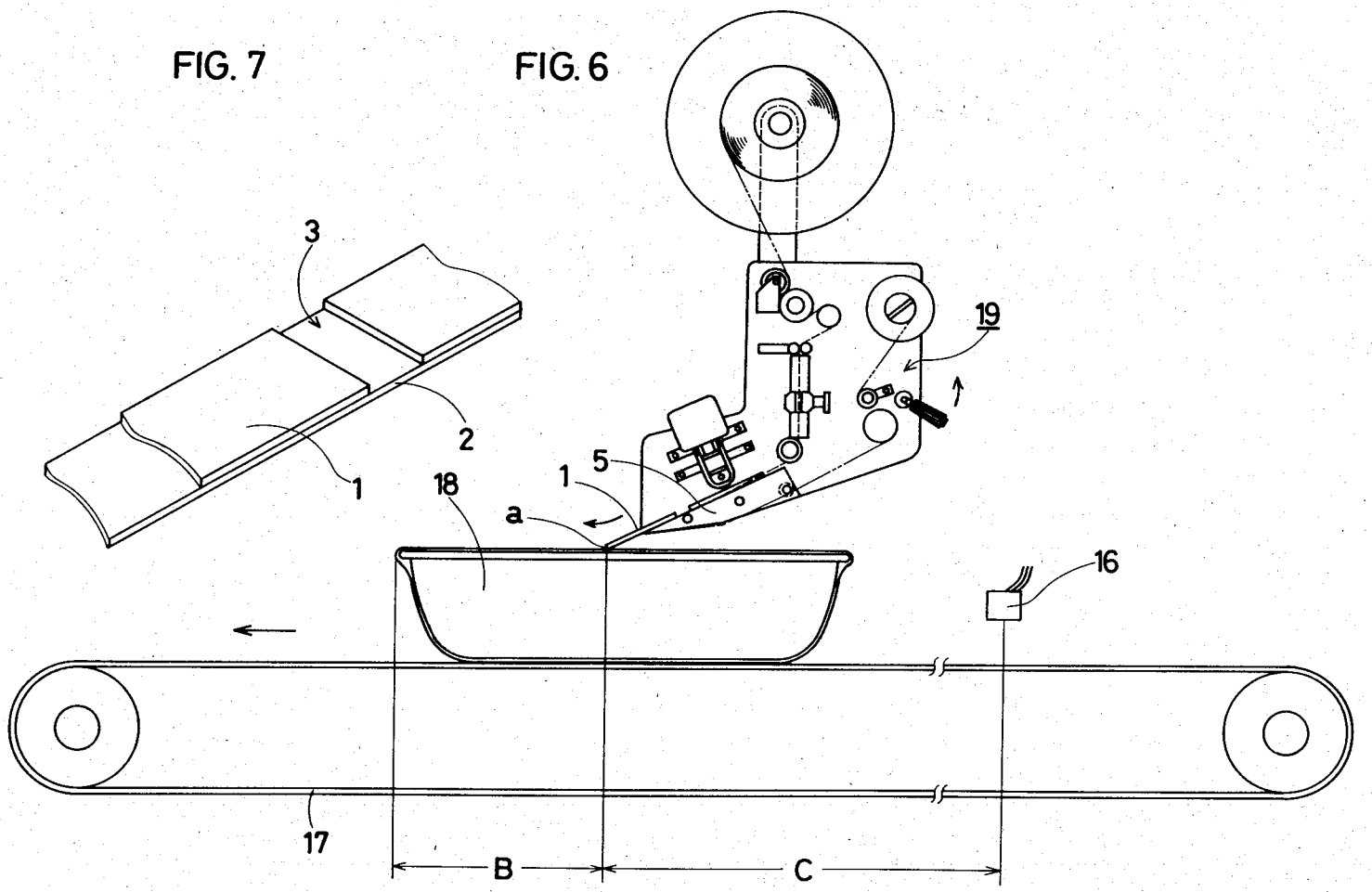
FIG. 6 is a diagrammatic front elevation showing the label application device of the invention in its entirety.
FIG. 7 is a perspective view, cut away in part, of a continuous line of labels used in the label application device of the invention.

The character A designates a distance. The distance A is a sum total of distance B and distance C as shown in FIG. 6. The distance B designates a distance from the front end of the article 18 in the direction of transfer to a portion a at which the front end of the label 1 comes into contact with the article 18. The distance C is a distance from a portion a at which the front end of the label 1 comes into contact with the article 18 to the detector 16.

The character H designates a set distance. The set distance H is a distance from a portion a at which the front end of the label 1 comes into contact with the article 18 to the detector and is distance parallel to a line of labels 3.

The character L designates a distance of one pitch as of a label. The pitch distance L is a distance totalling the length between the labels 1 adjacent to each other, namely the length between the preceding label 1 and the succeeding label 1 plus the length of one label 1.

The character D designates a phase distance. The phase distance D is a distance between the front end of the pressure sensitive label 1 and the detector 4. The phase distance D is a distance calculated by the equation $$D=H-\alpha L,\ D\leqq L$$

wherein $\alpha$ is an integer.

A description will now be given of the operation of the label application device according to the embodiment of the invention.

The user inputs set values for distances A, H, L numerically by the tens-key 7, plus-minus key 8, and selection key 9 of the application device. The control means 11 of the application device having the set value inputted thereinto substitutes the set value distances H and L inputted by the input unit 6 for the foregoing equation ($D=H-\alpha L$, $D\leqq L$, wherein $\alpha$ is an integer) to find the value of distance D. The control means 11 memorizes the set distances A, H and L and the value of the calculated and found distance D.

Figure 3:
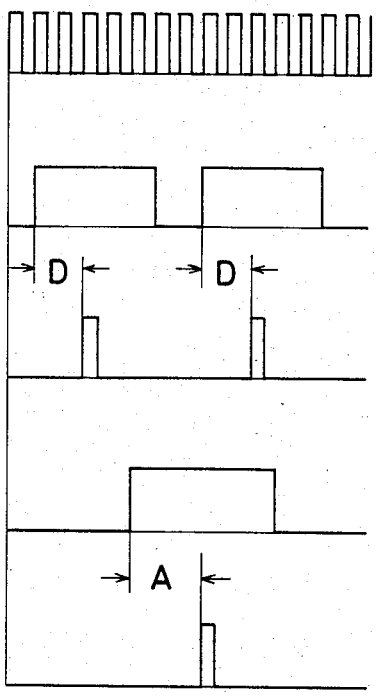
FIG. 3 is a timing chart of the embodiment.
Figure 8A:
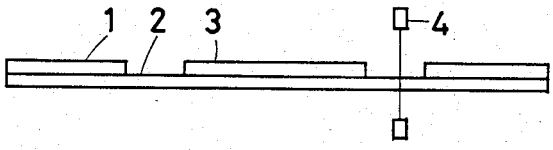
FIGS. 8(*a*) and 8(*b*) shows the relation between the conventional detector and the label.
Figure 8B:
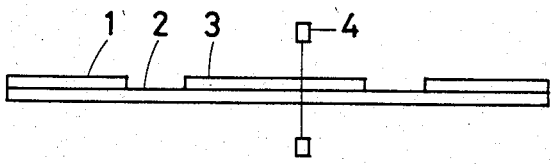
Figure 4:
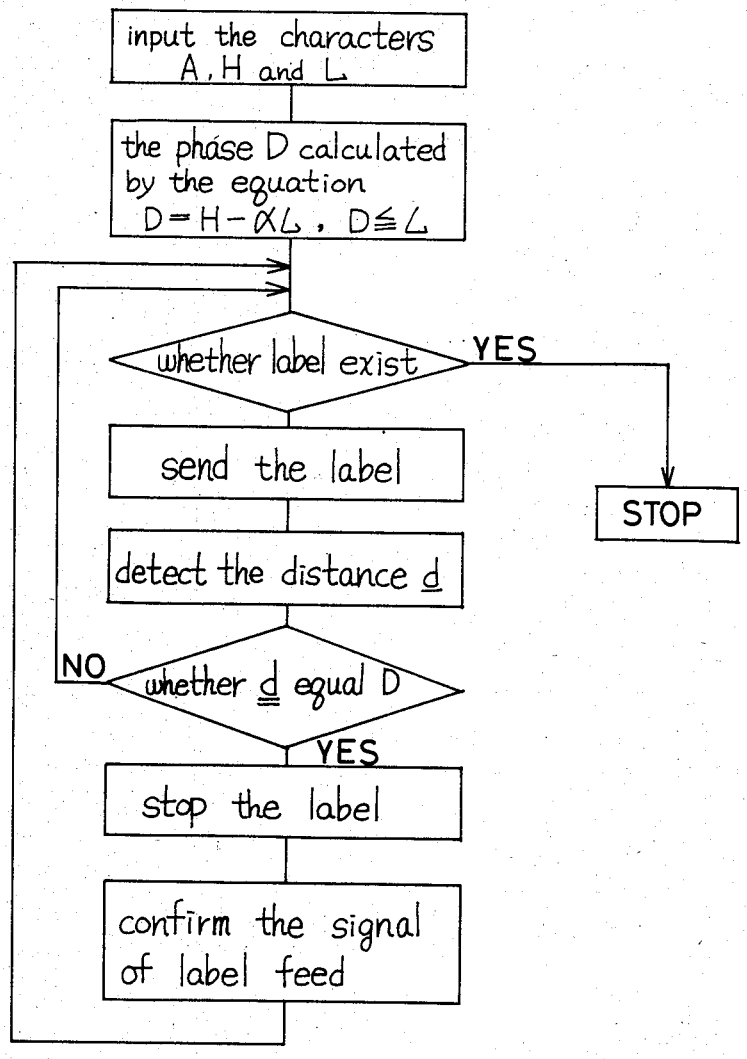
FIG. 4 is a flow chart of the embodiment.
Figure 5:
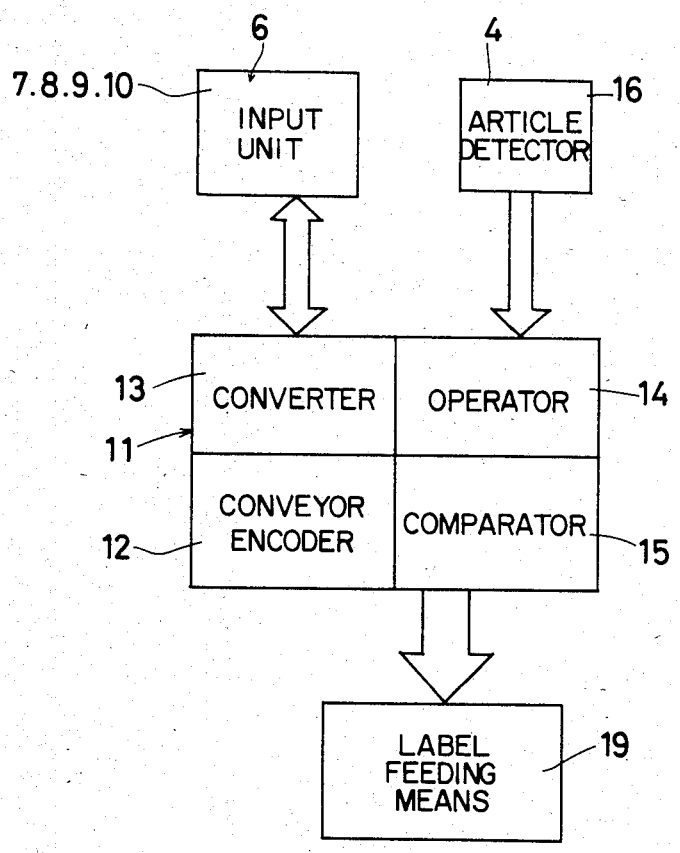
FIG. 5 is a block diagram of the embodiment.

Next, the label detector 4 detects the "presence" or "non-presence" of the label 1, and upon detection of the label, sends a detection signal to the control means 11. The control means 11 includes a pulse encoder 12*a*, a conveyor encoder 12, a converter 13, an operator 14, a comparator 15, etc. In this case, the following operation is effected in the control means 11 as shown in FIG. 3. The pulse encoder 12*a* generates a pulse corresponding to a distance over which the label 3 is fed. More specifically stated, the pulse encoder 12*a* generates a pulse corresponding to a label 3 feeding distance in synchronism with rotation of the motor for a label feeding means 19. The converter 13 converts a label detection signal from the label detector 4 indicating the "presence" of label into a pulse synchronized with the pulse generated by the pulse encoder 12*a*. The operator 14 calculates the number of pulses converted by the converter 13. The comparator 15 compares whether the distance D found by the set values previously inputted corresponds to the number of pulses calculated by the operator 14. The control means 11 stops feeding labels from the label feeding means 19 when the distance D found from the set values previously inputted coincides with the calculated number of pulses. The article detector 16 detects whether the article 18 has been transferred to the position corresponding to the set value. The detector 16 generates a label feeding signal, namely a label application starting signal, when the distance corresponding to the set point A passes after the detector 16 detected the article 18, as shown in FIG. 3.

More specifically stated, the conveyor encoder 12*b* generates a signal corresponding to a feeding distance of the article 18 in synchronism with rotation of the motor for driving the conveyor 17.

The converter 13 converts an article detection signal from the article detector 16 which started detecting the article 18 into a pulse synchronizing with the pulse generated by the conveyor encoder 12*b*.

The arithmetic and logic unit 14 calculates the number of pulses converted by the converter 13. The comparator 15 compares whether the distance corresponding to the set point A previously inputted corresponds with the number of pulses calculated by the operator 14. The control means 11 generates a label feed starting signal for the label feeding means 19, when the distance corresponding to the set value A previously inputted coincides with the calculated number of pulses. Feeding of labels by the label feeding means 19 starts again by the above signal, and then operations succeeding to the aforestated label detection are repeated. Namely, the following operations are repeated.

Label feeding by the label feeding means 19 is stopped when distance d has reached a distance equivalent to the value of distance D. In this case, the distance d is an actual distance from the front end of the label 1 detected by the label detector 4 to the label detector 4. Namely, the distance d is a distance which the label 3 moved in the direction of label feed after the label was detected by the label detector 4. The distance D is a distance found beforehand from the set values by the foregoing equation.

Label feed by the label feeding means 19 is commenced by an application signal from the article detector 16. The whole of the application device stops automatically when a continuous line of pressure sensitive labels is used up.

It should be understood that the invention is not limited to the embodiment illustrated but various changed and modifications may be possible. For example, the label detector and article detector may include a touch switch in place of the photoelectric switch. Furthermore, it may be possible to make the input unit read set points by a magnetic card. Also, the control means may be so designed as to start counting the pulse generated by the encoder in proportion to label feed speed when the means received a detection signal of "presence" of a label and to stop feeding labels in the position in which the number of pulses it counts amounts to the number of pulses corresponding to the value of D obtained from the set value by calculation in accordance with the equation ($D=H-\alpha L$, $D\leqq L$ wherein $\alpha$ is an integer).

This invention relieves the user of the trouble to move the position of the label detector each time the size of a label changes as was the case with conventional application devices and provides a label application device capable of speedily and exactly applying pressure sensitive labels to articles by merely pressing down the set point keys for numerical processing.

What is claimed is:

1. A pressure sensitive label application device comprising:

a backing material on which a plurality of labels are temporarily and releasably adhered at a predetermined pitch in the longitudinal direction thereof;

feeding means for feeding said backing material in the longitudinal direction thereof;

a label applying station formed in a feeding path of said backing material for stripping said label from said backing material and for applying the stripped label to an article;

label sensing means disposed on the upstream side of said label applying station in said feeding path of said backing material for sensing an edge of said label on said backing material;

first setting means for setting data related to a distance (D) between said label sensing means and an edge of the nearest label thereto when a label is present in said label applying station;

fed amount detecting means for detecting a fed amount (d) of said backing material in response to an output of said label sensing means;

first commanding means for applying a stop command to said feeding menas to stop feeding of said backing material if and when said fed amount (d) becomes equal to said distance (D) set by said first setting means;

second commanding means for applying a start command to said feeding means if and when said article reaches said label applying station;

said first setting means includes:

input means capable of inputting numerical data, and storing means for storing said numerical data inputted by said input means;

second setting means for setting data related to a distance (H) between said label sensing means and an edge of said label present at said label applying station;

third setting means for setting data related to a pitch (L) of said plurality of labels on said backing material; and said first setting means includes computing means for solving an equation ($D=H-\alpha L:L\geqq D$, where $\alpha$ is an integer) based on said data (H) and (L) from said second and third setting means to evaluate said data related to said distance (D).

2. A pressure sensitive label application device in accordance with claim 1, wherein said second and third setting means includes, respectively input means capable of inputting numerical data, and storing means for storing said numerical data inputted by said input means.

3. A pressure sensitive label application device in accordance with claim 1, wherein (D) is the distance between said label sensing means and the leading edge of the nearest label thereto, (H) is the distance between said label sensing means and a leading edge of the label present at said label applying station and the pitch (L) is the distance between leading edges of adjacent ones of said plurality of labels on said backing material.

* * * * *